US005931642A

United States Patent [19]

Friedman et al.

[11] Patent Number: 5,931,642

[45] **Date of Patent: *Aug. 3, 1999**

[54] PLASTIC COMBINED VACUUM AND HOLDING TANK

[75] Inventors: William J. Friedman, Wooster; James A. Sigler, Perrysville; Edward McKiernan, Wooster, all of Ohio

[73] Assignee: Sealand Technology, Inc., Big Prairie, Ohio

[ * ] Notice: This patent is subject to a terminal disclaimer.

[21] Appl. No.: 08/839,267

[22] Filed: Apr. 17, 1997

Related U.S. Application Data

[63] Continuation-in-part of application No. 08/551,029, Oct. 31, 1995, Pat. No. 5,681,148.

[51] Int. Cl.[6] ..... F04B 49/00

[52] U.S. Cl. ..... 417/36; 417/53; 4/431

[58] Field of Search ..... 417/36, 18, 53; 4/321, 323, 431, 417, 432, 433, 434

[56] References Cited

U.S. PATENT DOCUMENTS

| | | | |
|---|---|---|---|
| 3,142,443 | 7/1964 | Morgan | 239/24 |
| 3,663,970 | 5/1972 | Drouhard, Jr. et al. | 4/111 |
| 3,727,241 | 4/1973 | Drouhard, Jr. et al. | 4/10 |
| 3,801,015 | 4/1974 | Hayes | 239/175 |
| 4,521,925 | 6/1985 | Chen et al. . | |
| 4,672,690 | 6/1987 | Sigler | 4/423 |
| 4,717,040 | 1/1988 | Stanton . | |
| 4,819,279 | 4/1989 | Sigler | 4/300 |
| 4,865,631 | 9/1989 | Stroby et al. | 55/163 |
| 5,002,592 | 3/1991 | Stroby et al. | 55/169 |
| 5,139,655 | 8/1992 | Sigler | 210/140 |
| 5,214,807 | 6/1993 | Terve | 4/321 |
| 5,242,584 | 9/1993 | Hoarau . | |
| 5,345,618 | 9/1994 | Sigler | 4/321 |
| 5,408,704 | 4/1995 | Bailey et al. | 4/321 |
| 5,681,148 | 10/1997 | Friedman et al. | 417/36 |

FOREIGN PATENT DOCUMENTS

| | | |
|---|---|---|
| 2 482 157 | 11/1981 | France . |
| WO 96/41059 | 12/1996 | WIPO . |

*Primary Examiner*—Charles G. Freay
*Assistant Examiner*—Paul L. Ratcliffe
*Attorney, Agent, or Firm*—Nixon & Vanderhye P.C.

[57] ABSTRACT

A vacuum sewage handling assembly particularly for boats and recreational vehicles or caravans has a minimum of components because the conventional vacuum and holding tanks have been combined into a single substantially unreinforced, non-cylindrical, all plastic tank. The tank has a contoured, convoluted, discontinuous surface (e.g. formed by grooves, channels, and other discontinuities) so that it has no continuous flat surface area of more than about 80 square inches. The combined vacuum and holding tank may mount a vacuum pump, and optionally mounts a sewage discharge pump. The tank preferably has a generally parallelepiped configuration, and an interior volume of between about 45–65 liters, has a maximum vacuum level of about 26 cm of mercury, and is connected to other conventional portions of a vehicle toilet system, including outlets penetrating the exterior of the vehicle. The tank may have wheels and a handle.

20 Claims, 9 Drawing Sheets

Fig. 1
PRIOR ART
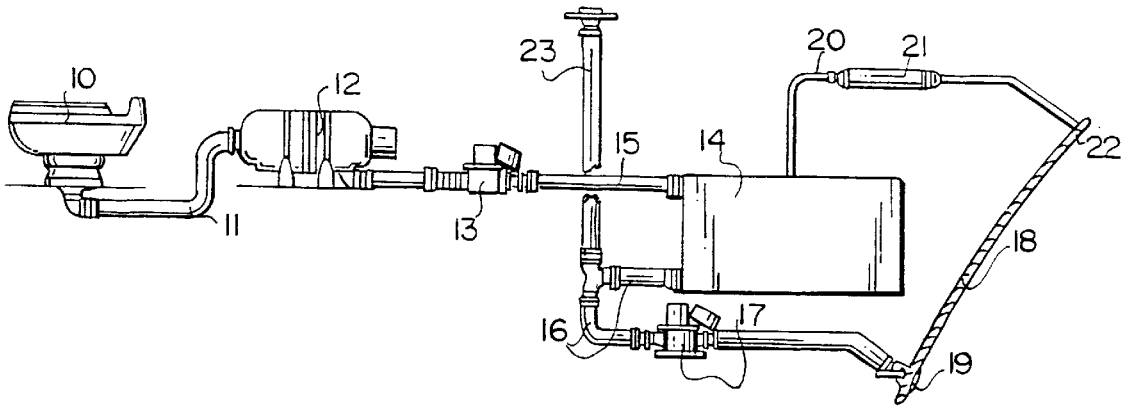
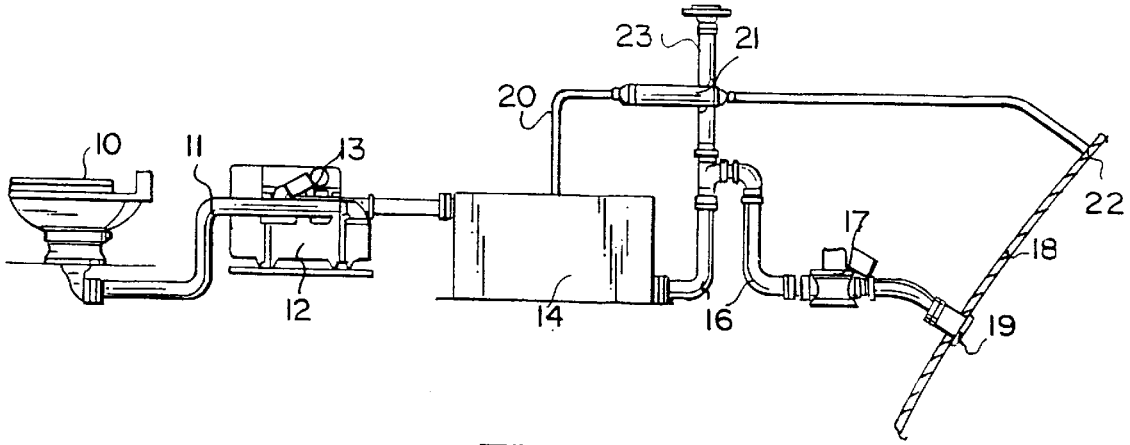
Fig. 2

Fig. 7
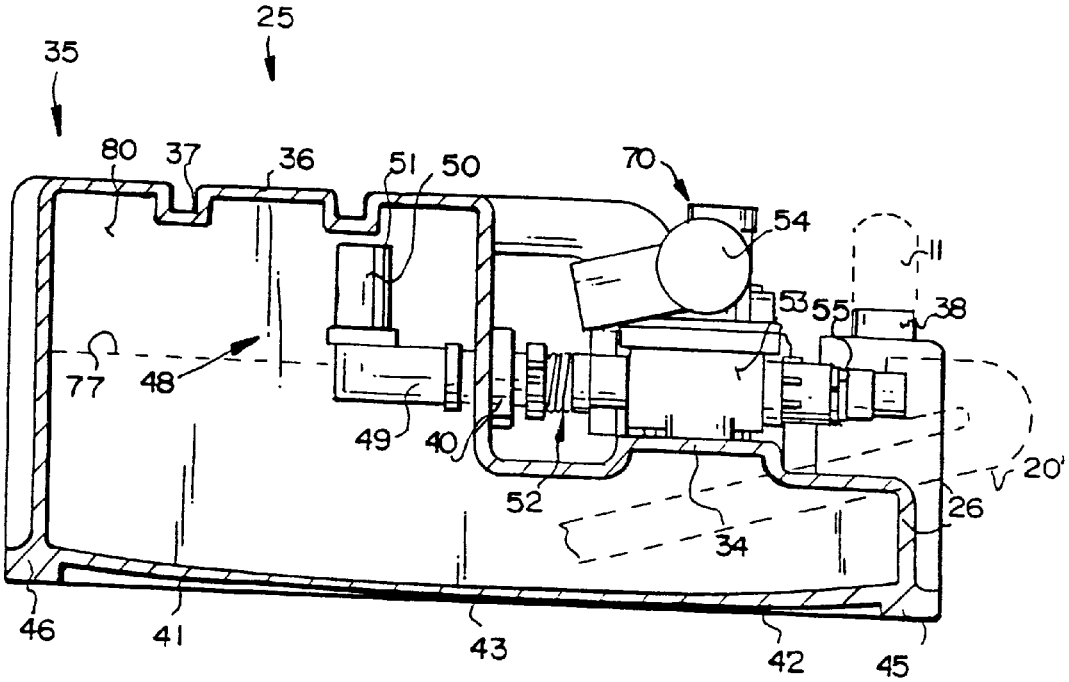
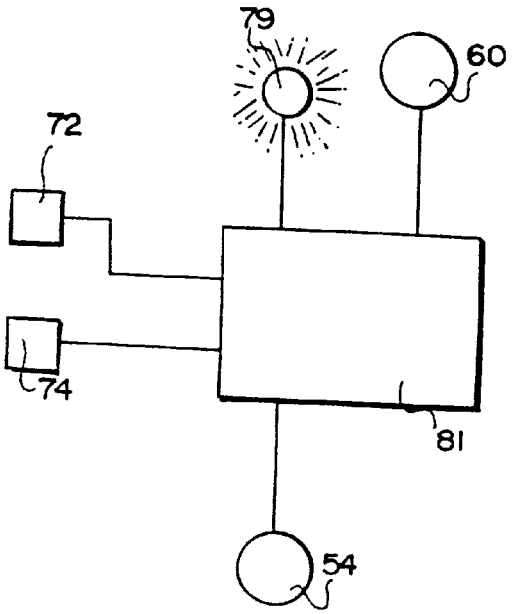
Fig. 9

PLASTIC COMBINED VACUUM AND HOLDING TANK

CROSS-REFERENCE TO RELATED APPLICATION

This application is a continuation-in-part of application Ser. No. 08/551,029 filed Oct. 31, 1995, now U.S. Pat. No. 5,681,148 (the disclosure of which is incorporated by reference herein).

BACKGROUND AND SUMMARY OF THE INVENTION

The "VACU-FLUSH"® toilet system for boats and recreational vehicles manufactured by Sealand Technology, Inc. of Big Prairie, Ohio, has for many years effectively provided a vacuum system facilitating flushing of a vacuum toilet and holding of the sewage from the toilet until there is a need or opportunity to properly dispose of it. Initially, this system included four main components, a vacuum toilet connected to a vacuum tank, in turn connected to a vacuum pump, in turn connected to a holding tank, such as shown in U.S. Pat. No. 4,819,279. The number of components was effectively reduced from four to three by efficiently combining the vacuum pump with the vacuum tank, such as shown in U.S. Pat. No. 5,408,704 and WO 96/41059 (the disclosures of which are both hereby incorporated by reference herein). The invention relates to a still further development of such a toilet system which is particularly suitable for use in boats and caravans or recreational vehicles, where space is at a premium or where relevant cost factors apply.

According to the present invention a single plastic combined vacuum tank and holding tank is provided. The tank is unreinforced— that means, as used in this specification and claims, that it has no reinforcing elongated fibers, such as glass or metal filaments, integrally incorporated with the plastic material (although other materials, such as talc or glass powder, may be utilized). The tank may also directly mount the vacuum pump. This means that the system has a minimum number of components (two), a vacuum toilet and a combined vacuum/holding tank and vacuum pump, or three if the vacuum pump is disposed distinct from the tank. While the number of components have been reduced according to the invention, the functionality of the system is not significantly compromised. Rather only cost saving, space saving, and operational advantages ensue.

While it has been known per se to use a combined vacuum and holding tank for sewage systems, the prior art constructions have included expensive tank materials and/or have necessarily been cylindrical (with domed ends), and do not have the low cost or space saving advantages according to the invention. For example U.S. Pat. No. 3,663,970 relates to a system in which a fiberglass or fiberglass reinforced combined vacuum and holding tank is provided, requiring the use of pressure to expel waste, and because of the materials utilized is expensive. U.S. Pat. No. 5,002,592 shows a cylindrical (with domed ends) metal tank connected to a blower and for also for holding sewage, while U.S. Pat. No. 5,214,807 shows a dual wall tank. While all plastic tanks per se have been known before for vehicle sewage systems, such as in U.S. Pat. No. 5,408,704, they were relatively small (only for vacuum in the U.S. Pat. No. 5,408,704), and it was unknown that an all unreinforced (e.g. rotational molded or injection molded) plastic larger tank was possible, such as a combined vacuum and holding tank as according to the invention.

It is possible to provide a non-cylindrical (e.g. generally parallelepiped) combined vacuum and holding tank of substantially unreinforced all plastic according to the invention by providing a tank having convoluted, discontinuous surfaces (e.g. the discontinuities provided by grooves, channels, or other discontinuities), so that the tank has no continuous flat surface area of more than about 80 square inches. The size (interior volume) of the tank according to the invention typically is about 45–65 liters (e.g. about 14 gallons), and normally, although not necessarily under all circumstances, the vacuum portion of the tank is about 12 liters or more (e.g. under the minimum vacuum portion situation the liquid/sewage portion of the tank is about 43 liters).

According to one aspect of the present invention a combined vacuum and holding tank assembly is provided comprising the following components: A substantially hollow unreinforced non-cylindrical all plastic tank having first and second (substantially planar) ends, first and second (substantially planar) sides, at least one pump-mounting surface, first and second outlets, an inlet, an upper surface, and a bottom. A vacuum pump mounted on the at least one pump-mounting surface exteriorly of the tank. A downwardly extending sewage transporting tube disposed within the tank connected to the first outlet. A gas inlet tube disposed within the tank and connected to the second outlet, and having a top open end adjacent (i.e. near) the tank upper surface. And a connection between the vacuum pump and the second outlet exterior of said tank.

If desired a sensor may be provided for sensing the level of liquid in the tank, as well as means for precluding operation of the vacuum pump if the sensed level within the tank becomes closer than a predetermined amount to the air inlet tube open top end so that a gas volume is always provided adjacent the upper surface inside the tank. If provided the means for precluding operation of the vacuum pump if the sensed level within the tank rises too high ensures that sewage doesn't pass out the vacuum pump (which is usually capable of pumping liquid too). For example in typical operation, the tank would have a waste holding capacity of about 40–45 liters (about 10 to 11 gallons), and operate with a minimum of about 12 liters (about three gallons) of vacuum, which is generated to between 20–26 cm (about 8–10 inches) of mercury (as is conventional per se). In response to the sensing of the level of the waste, a relay may be closed or opened to detach the vacuum pump from its power source so that it can no longer operate until the liquid level drops, or a controller may be provided to take information from the sensor and disable the vacuum pump in any known manner. The sensor too may be any conventional structure, such as an optical, sonar (including ultrasound), piezoelectric, fluidic, or mechanical sensor. For example a conventional float operated sensor can be utilized.

Typically a gas discharge tube is connected to the vacuum pump for discharging gas from the tank, e.g. penetrating an exterior partition wall of a boat (e.g. boat hull) or caravan or recreational vehicle (e.g. side panel or bottom) in which the tank is mounted, and a conduit is typically connected to the first outlet for discharging sewage from the tank. The at least one pump-mounting surface may comprise a top surface, and may include a second pump-mounting top surface. In that case an optional sewage discharge pump may be mounted on the second pump-mounting top surface and connected to the first outlet. A conduit is preferably provided connecting the inlet to at least one vacuum toilet.

The substantially unreinforced plastic tank may be rotational molded from linear low density polyethylene (with or without additives), although a wide variety of other plastics may be utilized, and other manufacturing techniques. Rotational molding is preferred, however, since it is easy and inexpensive and does not require seams in the tank (which must be sealed, as is necessary with injection molding). If the tank is injection molded (if sales volume justifies) a wide variety of plastics, including ABS, may be used. The convoluted, discontinuous construction of the tank surface typically includes reinforcing grooves or channels formed in the raised portion, and a similar grooved configuration is desirably provided for all surface of the tank. Also the first and second outlets are typically on opposite sides of a vertical plane substantially bisecting the tank and intersecting the first and second ends thereof, and face in opposite directions.

A vacuum switch is preferably mounted to the tank for sensing the level of vacuum in the gas volume. Any conventional construction of vacuum switch, or like device, may be utilized, the details of the vacuum sensing not being significant. Typically the vacuum switch is calibrated to start operation of the pump if the level of vacuum in the gas volume is lower than a predetermined amount (e.g. if lower than about twenty centimeters—eight inches—of mercury the vacuum pump is operated until the gas volume is evacuated to a level of about twenty five centimeters—roughly about ten inches—of mercury). The tank typically maintains a maximum level of vacuum of about twenty six cm of mercury.

Typically the bottom of the tank is formed with a slope toward a sump, and integral plastic legs support the tank on a horizontal surface so that the sump is the lowest part of the tank. The downwardly extending tube preferably comprises a dip tube having an end termination cut at an angle, defining a generally oval-shaped opening disposed just above the sump. In this manner the general configuration of the tank bottom and the dip tube configuration are such as illustrated in WO 96/41059.

According to another aspect of the present invention a sewage handling assembly is provided for a boat, RV or caravan, plane or train comprising the following components: At least one toilet having a waste discharge therefrom. An unreinforced non-cylindrical all plastic combined vacuum and holding tank including an inlet and first and second outlets. A conduit connecting the tank inlet to the toilet waste discharge. A vacuum pump connected to the second outlet. A gas handling conduit from the vacuum pump including an end termination penetrating the boat, plane, train or recreational vehicle exterior partition. A sewage handling conduit operatively connected to the first outlet and having an end termination penetrating the partition. And, the tank having a top and a bottom, sewage from the toilet provided in the bottom, and gas at less than atmospheric pressure provided in the top (usually, but not necessarily, at all times).

The details of the tank, etc., preferably are as described above, including having an interior volume of about 45–65 liters, a generally parallelepiped configuration, and a contoured, discontinuous, convoluted surface which has no continuous flat surface area of more than 80 square inches. Also a vacuum relief valve may be provided in the tank, and the tank may have rolling facilitating elements (such as wheels, casters or rollers).

It is the primary object of the present invention to provide the optimum in simplicity and cost effectiveness for the handling of sewage from one or more vacuum toilets, particularly in association with boats, recreational vehicles or caravans, planes, trains, and other vehicles. This and other objects of the invention will become clear from an inspection of the detailed description of the invention and from the appended claims.

BRIEF DESCRIPTION OF THE DRAWINGS

FIG. 1 is a side schematic view of a conventional prior art VACU-FLUSH® sewage handling system for a boat, caravan or RV, or the like;

FIG. 2 is a view like that of FIG. 1 showing the simplified system of WO 96/41059;

FIG. 7 is a view like that of FIG. 5 only taken along lines 7—7 of FIG. 4;

FIG. 9 is an exemplary control schematic for the system of FIG. 3;

DETAILED DESCRIPTION OF THE DRAWINGS

Figure 3:
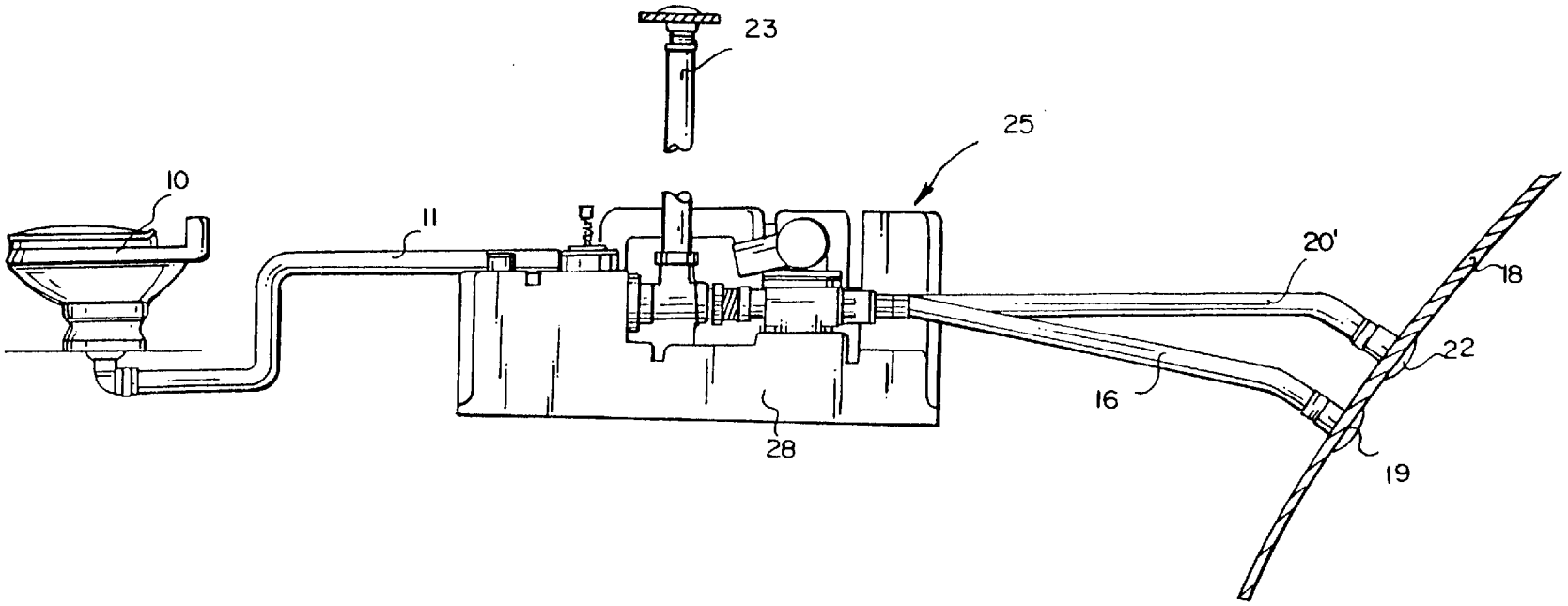
FIG. 3 is a view like that of FIGS. 1 and 2 of the still further simplified system according to the present invention.

In the conventional VACU-FLUSH® system as illustrated in FIG. 1, at least one vacuum toilet 10 having a waste discharge on the bottom thereof is connected by a conduit 11 (typically a flexible hose) to a vacuum tank 12. A vacuum level of about 20–26 cm (8–10 inches) of mercury is maintained in the tank 12 by the vacuum pump 13, a conventional vacuum switch on the tank 12 operating the pump 13 to maintain an appropriate vacuum. When the pump 13 is operated to replenish the vacuum in the vacuum tank 12, sewage is pumped to the holding tank 14 via conduit 15. The sewage ultimately is discharged from the holding tank 14 via conduits 16 perhaps by using an optional sewage discharge pump 17 which is operated only when there is a mechanism for proper disposal of the sewage. The exterior partition 18 in FIG. 1 comprises an exterior partition of a boat, caravan or recreational vehicle, plane, train, or other vehicle, e.g. simulating the form of boat hull in the actual illustration in FIG. 1. The exterior partition 18 is penetrated by termination 19 of the conduit 16 from the tank 14. When the pump 17 is not used the termination 19 is merely connected up to a pump-out facility at a dock, campsite, terminal, or the like. Conventional valves are provided to preclude sewage from being discharged from the tank 14 into conduit 16 unless there is a motive force appropriate for discharging the sewage to a suitable location.

From the holding tank 14 is a conventional vent 20, which may have a suitable filter therein such as shown in U.S. Pat.

No. 5,139,655, with an end termination 22 of the conduit 20 penetrating the partition 18 to vent odoriferous gases from the holding tank 14 to the atmosphere. Another conventional vent 23 is typically also provided from the conduit 16, typically penetrating another partition (e.g. boat deck) of the vehicle in which the toilet 10 is provided.

FIG. 2 illustrates a system according to WO 96/41059. In this system components comparable to those in the FIG. 1 embodiment are shown by the same reference numeral. Note that in this case the vacuum tank 12 and the vacuum pump 13 have been combined, thus reducing the number of major components by one compared to the system of FIG. 1.

FIG. 3 schematically illustrates a system according to the present invention. In FIG. 3 components comparable to those in FIG. 1 are shown by the same reference numeral. Note, however, that in this embodiment the vent tube 20' is shown slightly different in configuration, and without a filter, although a filter may be provided. In the system of FIG. 3 the only two major components are one or more vacuum toilets 10 and the combined vacuum/holding tank 25, which may mount a vacuum pump (like pump 13).

Figure 4:
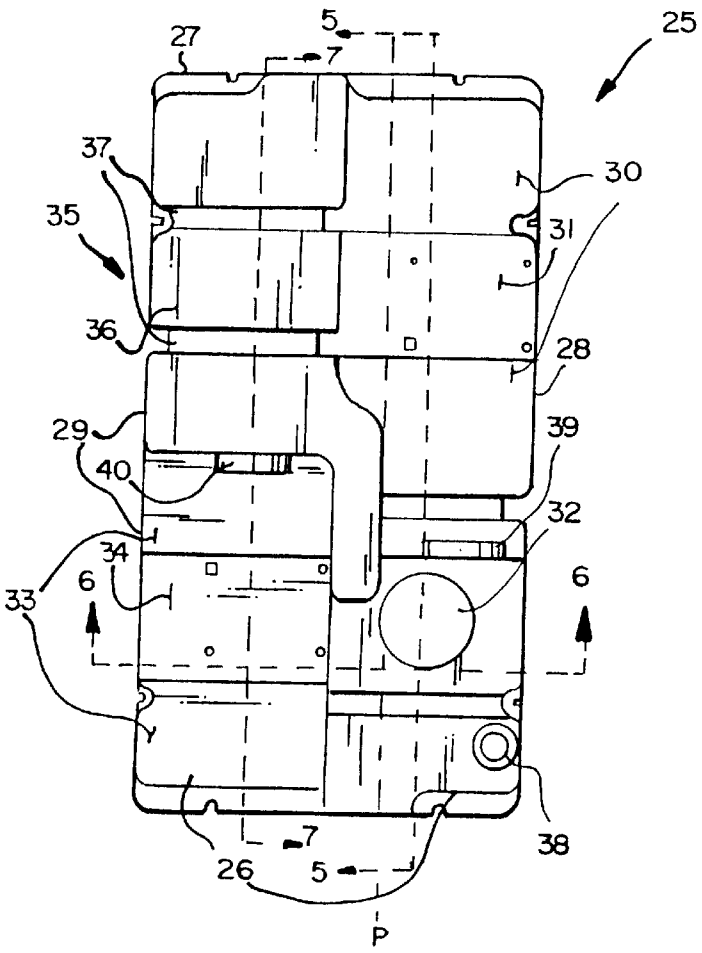
FIG. 4 is a top plan view of the tank according to the present invention (alone), of the system of FIG. 3.

FIG. 4 is a top plan view of the tank 25 per se. Note that the tank 25 has first and second end walls 26, 27 and first and second side walls 28, 29, the side wall 28 being seen in FIG. 3. It also includes top surfaces 30 adjacent the side wall 28 with a top pump-mounting surface 31, and a raised portion 32. On the opposite side of the tank 25 from the surfaces 30–32 (e.g. on the other side of an imaginary vertical plane P substantially bisecting the tank 25 and intersecting the end walls 26, 27) are the top surfaces 33, with another pump-mounting top surface 34 therebetween. Also provided is a raised portion shown generally by reference numeral 35, which includes an upper surface 36 with reinforcing grooves 37 formed therein. Also seen in FIG. 4 are an inlet 38 to the hollow interior of the tank 25, a first outlet 39, and a second outlet 40. Note that the outlets 39, 40 are on opposite sides of the plane P and face in opposite directions. All of the components 38–40 preferably are substantially circular in cross-section and are adapted to be readily connected to various conduits, pumps, or other fluid transmitting elements.

The non-cylindrical tank 25—as clearly illustrated in all of the drawings—has a number of irregularities in the surface thereof, which may be characterized as grooves or channels; that is the surface is convoluted, discontinuous, and contoured. These irregularities are provided so that there is no flat continuous surface of the tank 25 which is greater than about two hundred square centimeters (about eighty square inches) in area. This allows the tank 25 to be generally parallelepiped (having space savings over a cylindrical construction) and yet be made completely of substantially unreinforced plastic and still function properly. For example the tank 25 may be inexpensively and easily made by conventional rotational molding techniques from a wide variety of plastics, or may be blow molded. One particularly desirable plastic is linear low density polyethylene (with or without additives), although other plastics may be utilized, such as other polyolefins (e.g. polypropylene or other polyethylenes). Also, where sales volume justifies it, the tank may be injection molded, such as of ABS or PVC. Tank 25 is much larger than other all plastic tanks used in association with vehicle toilet systems (such as the vacuum (only) tank of U.S. Pat. No. 5,408,704), typically having a total interior volume of about 45–65 liters.

Figure 8:
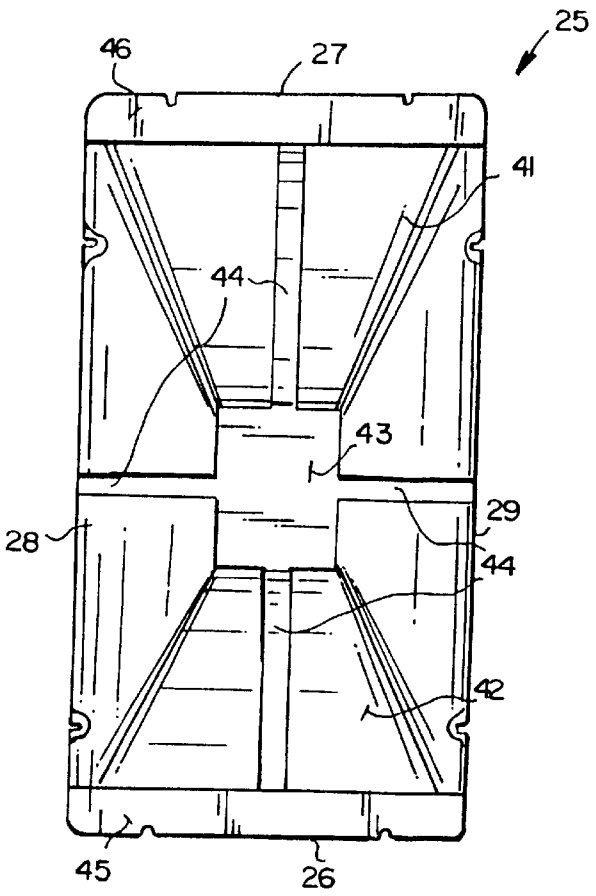
FIG. 8 is a bottom plan view of the tank of FIG. 4.

As seen in FIG. 8 the bottom of the tank 25 preferably comprises downwardly sloping surfaces 41, 42 which meet at a sump 43 in a somewhat central location in the bottom, and stiffening ribs 44 preferably are provided integrally molded with the tank surface portions forming the bottom. Integrally formed feet 45, 46 are preferably provided at the ends 26, 27, respectively, of the tank 25 bottom and support the tank 25 on a substantially horizontal surface so that the sump 43 is the bottom-most portion of the tank 25 during normal use.

FIG. 7 shows the tank 25 particularly as associated with the vacuum pump and related components. Connected to the second inlet 40 is a gas inlet tube shown generally by reference numeral 48. The gas inlet tube 48 may have almost any suitable configuration; the configuration specifically illustrated in FIG. 7 is a generally horizontally extending component 49 from which a generally vertically extending component 50 projects upwardly having an open end 51 adjacent the interior of the upper surface 36 of the tank 25 raised portion 35. The opening 51 is preferably placed as close to the highest interior surface of the tank 25 as possible (e.g. from about 0.25 to 4.0 cm.), while still allowing ready flow of air and other gas thereinto, in order to minimize the possibility that sewage will splash into or otherwise enter the open end 51. If splash guards, or the like, are used, the spacing may be further than if not used, and if used in a system which does not move (as does a boat), the spacing also can be greater.

Mounted on the surface 34 is a vacuum pump 53 of conventional construction (comparable to the pumps 13 in FIGS. 1 and 2). The vacuum pump 53 is typically driven by an electric motor 54, although any suitable conventional type of vacuum pump drive may be utilized. Any conventional suitable connection (a screw connection being illustrated in the exemplary embodiment illustrated in FIG. 7) 52 may be provided connecting the outlet 40 to the vacuum pump 53, and a discharge conduit 55 from the vacuum pump 53 is typically connected to the conduit 20', as illustrated in dotted line in FIG. 7. FIG. 7 also illustrates the inlet 38 connected to the conduit 11, also shown in dotted line. It is to be understood that any suitable conduits may be associated with the components illustrated in FIG. 7; for example the inlet conduit connected to the inlet 38 may be such as illustrated in WO 96/41059.

Figure 5:
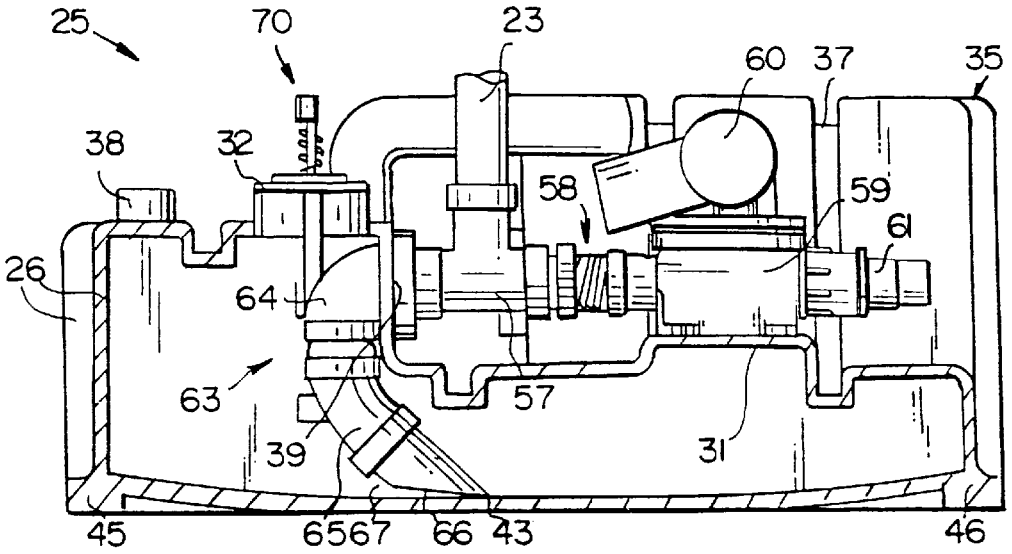
FIG. 5 is a longitudinal view, partly in cross-section and partly in elevation, taken along lines 5—5 of FIG. 4.

FIG. 5 is the opposite side cross-sectional/elevational view of the tank assembly including the tank 25. In this case a connection 58 of conventional construction (e.g. a screw connection, connected through the deck discharge 23 if on a boat) is connected to the first outlet 39 of the tank 25 and a discharge pump 59 is optionally mounted on the surface 31, the pump 59 comparable to the pump 17 in FIGS. 1 and 2 and operated by a motor 60 (such as an electric motor). Where the pump 59 is utilized the discharge outlet 61 therefrom is connected to the conduit 16, but where the pump 59 is not utilized any suitable conduit like the conduit 16 is provided connected directly from the outlet 39 (or the deck discharge 23) to the end termination 19. The end termination 19 may be connected to a suitable pump-out device at a dock, campsite, or the like.

Connected to the first outlet 39 inside the tank 25 is the downwardly extending tube, such as shown generally at in FIG. 5. The tube 63 may have any suitable configuration and that illustrated in FIG. 5 is only exemplary, although a desirable configuration. In this form the tube 63 might be properly characterized as a dip tube assembly including dip tube 64 including a tubular portion 65 that is substantially circular in cross-section and elongated about an axis, and having an open end termination 66 cut at an angle to its axis of elongation and defining a substantially oval-shaped opening which is above but spaced from the vacuum tank 25 bottom adjacent the sump 43. In this way the dip tube assembly 63 is preferably substantially identical to that illustrated in WO 96/41059.

Figure 6:
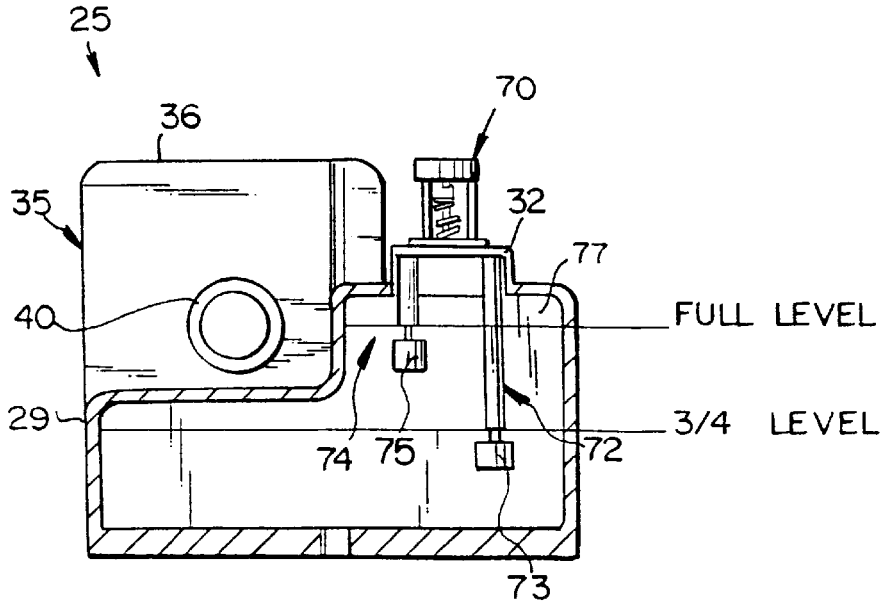
FIG. 6 is an end view, partly in cross-section and partly in elevation, taken generally along lines 6—6 of FIG. 4.

The assembly according to the invention also comprises a conventional vacuum switch 70, which is seen in FIGS. 5 and 6 is typically mounted on the raised surface 32 of the tank 25, adjacent the inlet 38. The vacuum switch 70 may comprise any conventional suitable vacuum switch or like device such as shown in U.S. Pat. No. 4,819,279, which senses the vacuum within the gas volume within the tank 25 and operates the vacuum pump 53 if the level of vacuum falls below a predetermined minimum. As is conventional, the vacuum switch 70 typically senses when the vacuum level has dropped to about twenty cm (about eight inches) of mercury, and then operates the pump 53 until the level of vacuum is raised to about twenty five cm (about ten inches) of mercury. The tank 25 typically maintains a maximum level of vacuum of about twenty six centimeters of mercury.

The assembly according to the invention also comprises a sensor for sensing the level of liquid (sewage) in the tank 25. Conventional sensors are illustrated schematically at 73 and 74 in FIGS. 6 and 9. In FIG. 6 the sensors 72, 74 are illustrated as conventional float operated sensors, the floats being schematically illustrated at 73 and 75. The sensor 72 and associated float 73 comprise a three-quarters full level indicator (e.g. operating indicator light 79 in FIG. 9), while the sensor 74 and associated float 75 comprise a full level sensor. While mechanical sensors 72, 74 are illustrated in FIG. 6 it is to be understood that any suitable conventional sensor or sensors, whether optical, sonar, piezoelectric, fluidic, or the like, may be provided. Note that the levels of sewage for three-quarter full and full are indicated by reference lines 76 and 77 in FIG. 6.

Typically the full level indicated by line 77 is between about twenty four–forty four liters (six–eleven gallons), leaving a gas volume (primarily in the raised portion 35)—and shown by reference numeral 80 in FIG. 7—of between about ten and sixteen liters (about two and one-half-four gallons (e.g. 3.0–3.5 gallons)). Once the full level 77 has been reached—which is far enough below the open top 51 of the gas inlet 48 so that it is unlikely sewage could enter the open end 51—suitable means are provided for precluding operation of the vacuum pump 53, so that a gas volume is always provided adjacent the upper surface 36 inside the tank 25. Such means are schematically illustrated at 81 in FIG. 9. Such means may comprise any suitable conventional means, such as a conventional relay that is opened or closed to shut off the power (e.g. from a battery or other source of electricity) to the pump 54, or otherwise effectively disable the pump 54 by opening or closing valves, or the like; or more sophisticated components may be provided such as controllers (like computer controllers), etc. Also the indicator light 79 may light a different color—or an additional indicator light 79 may be provided—when the full level is being indicated as opposed to three-quarters level.

Figure 10:
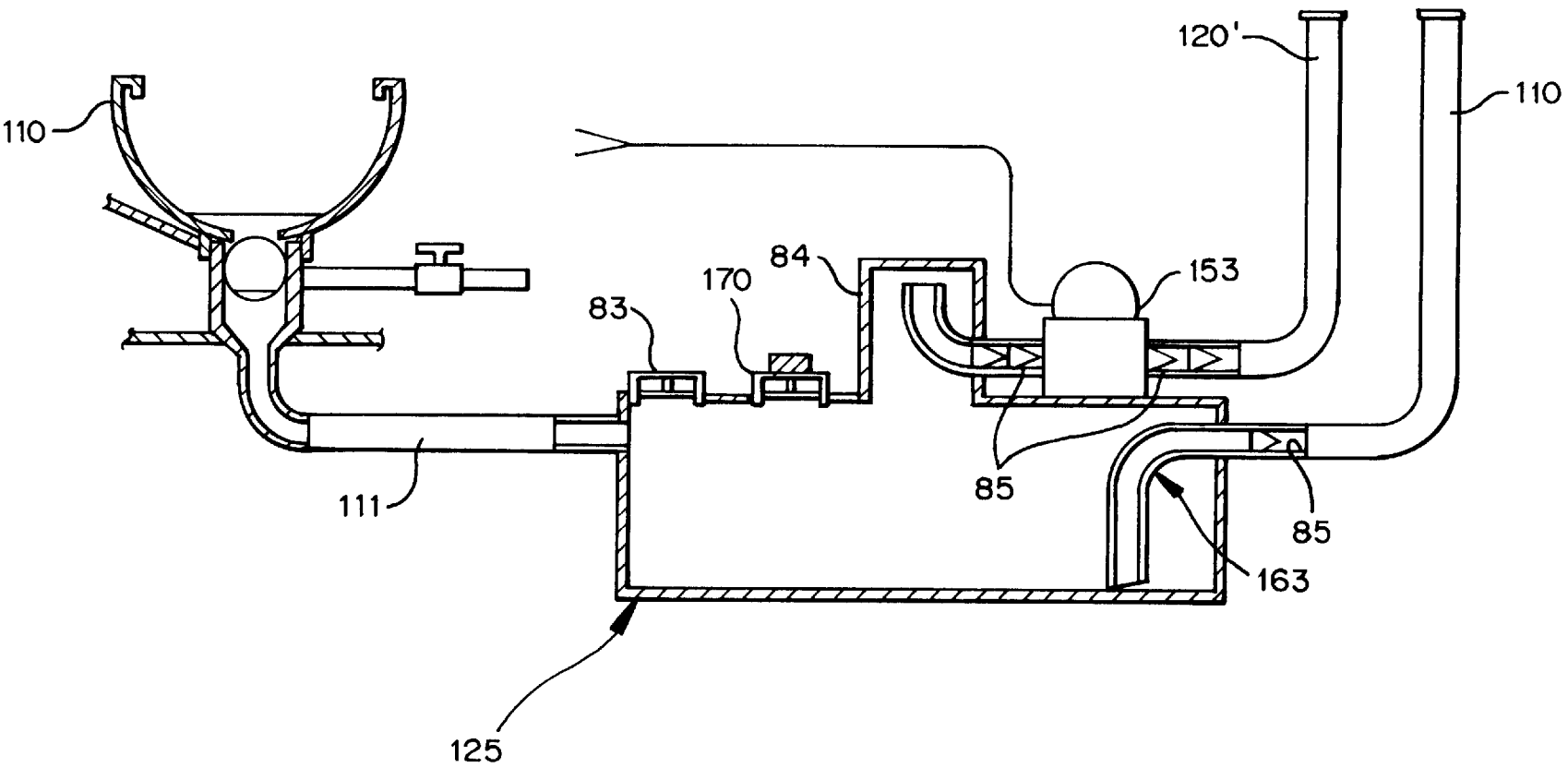
FIG. 10 is a side schematic view, with the tank and toilet shown in cross-section, of another exemplary embodiment of a system according to the present invention.

FIG. 10 shows a slightly different configuration of the components of a vacuum toilet system according to the present invention. In the embodiment of FIG. 10 components comparable to those in the FIGS. 3–9 embodiment is shown by the same reference numeral only preceded by a "1".

The all unreinforced plastic combined vacuum and holding tank 125 is connected to toilet 110 by conduit 111, and includes a vacuum differential switch 170 in the top surface thereof, and also a vacuum relief valve 83, such as shown in copending U.S. patent application Ser. No. 08/717,904 filed Sep. 23, 1996. An actual dome 84 is provided in the top surface of tank 125 which contains the inlet pipe 151 for the vacuum pump 153. The vacuum pump 153 may be of very simple construction, such as an inefficient air pump (capable of pumping some liquid if it is flooded), and is mounted on the top surface of the tank 125. Conventional check valves 85 may be provided where desired.

Figure 11:
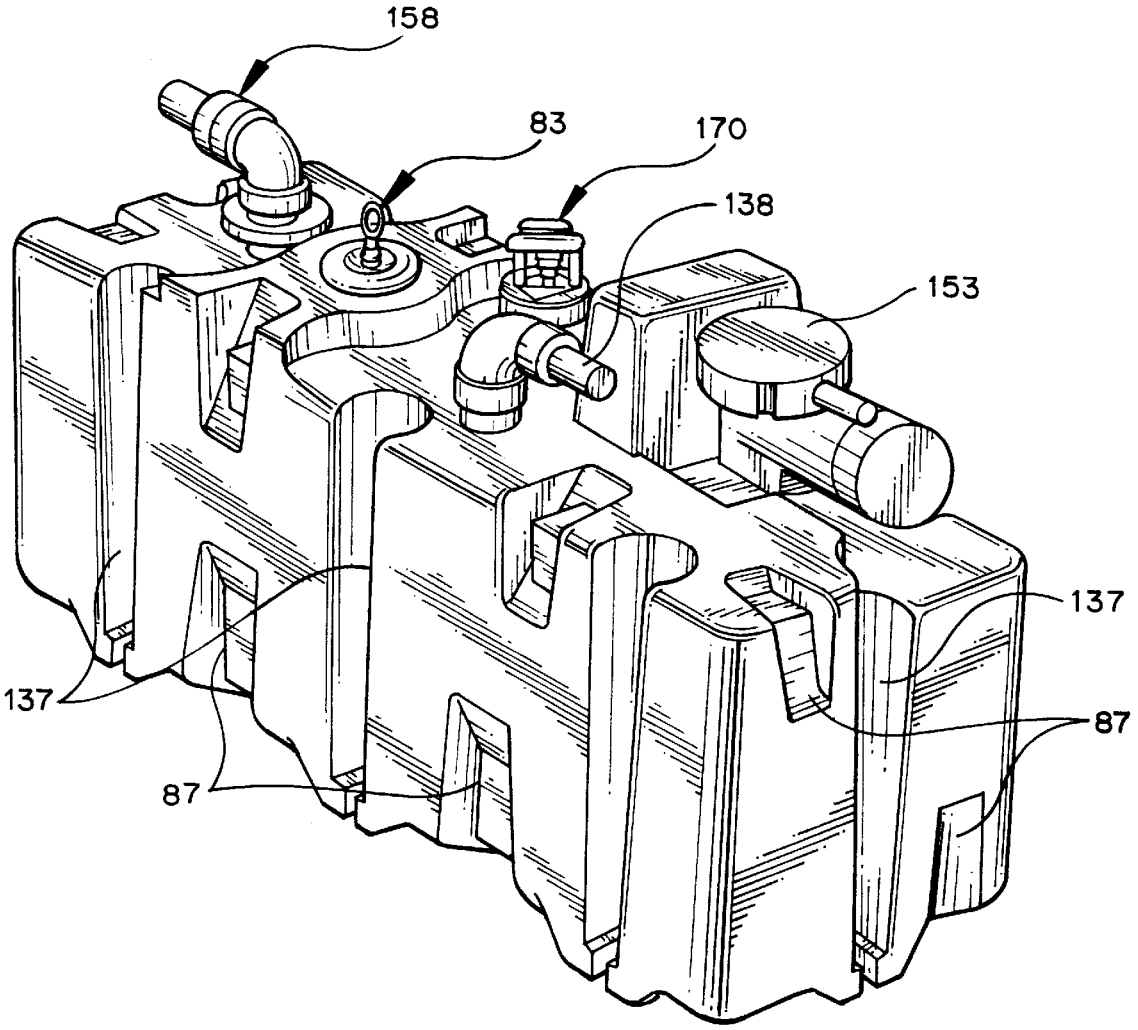
FIG. 11 is a top perspective detail view of a tank according to the invention utilizable in the system of FIG. 10, and with a vacuum switch, vacuum relief valve, pump, and external fittings, thereon.

The tank 125 is shown only schematically in FIG. 10, but is shown—in one exemplary embodiment—in more detail in FIG. 11. As seen in FIG. 11, the tank 125 exterior surface has numerous grooves or channels 137, as well as other discontinuities 87, to insure that no continuous flat surface is greater than about 80 square inches. An external fitting 158 may be connected to conduit 116 and have a check valve 85 therein, and extend as illustrated from the top surface, connected to tube assembly 163. The inlet fitting 138 may also be provided in the top surface of the tank 125. Both fittings 138, 158 may be rotatable in a conventional manner for ease of connection to other components of the system of FIG. 10. In the FIG. 11 embodiment a discharge pump (like the pump 59) is not provided, but rather the tank 125 would be emptied by connection to an exterior pump, or the like.

Figure 12:
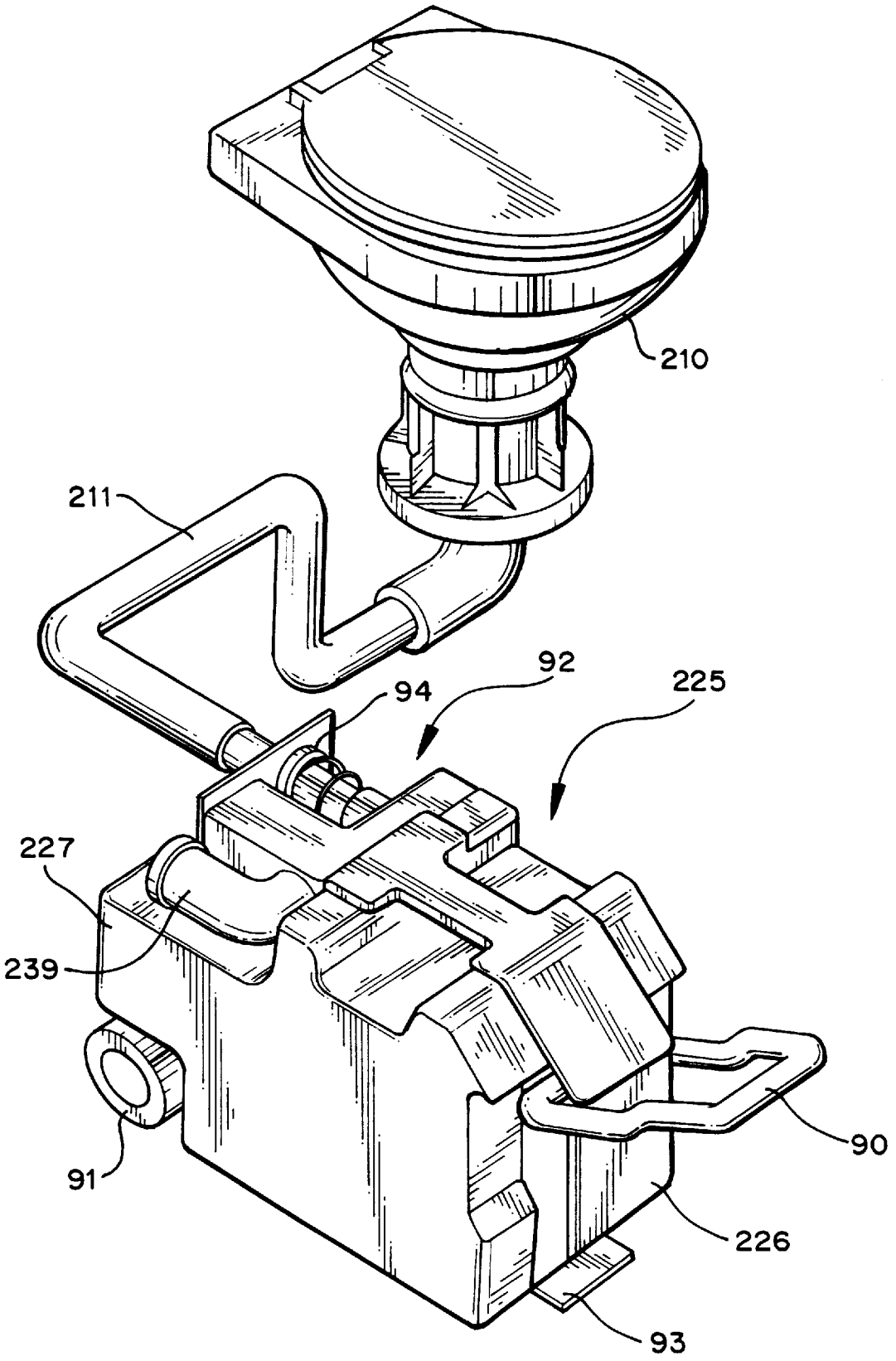
FIG. 12 is a top perspective schematic view of another embodiment of an exemplary tank according to the invention in association with a marine or RV toilet.
Figure 13:
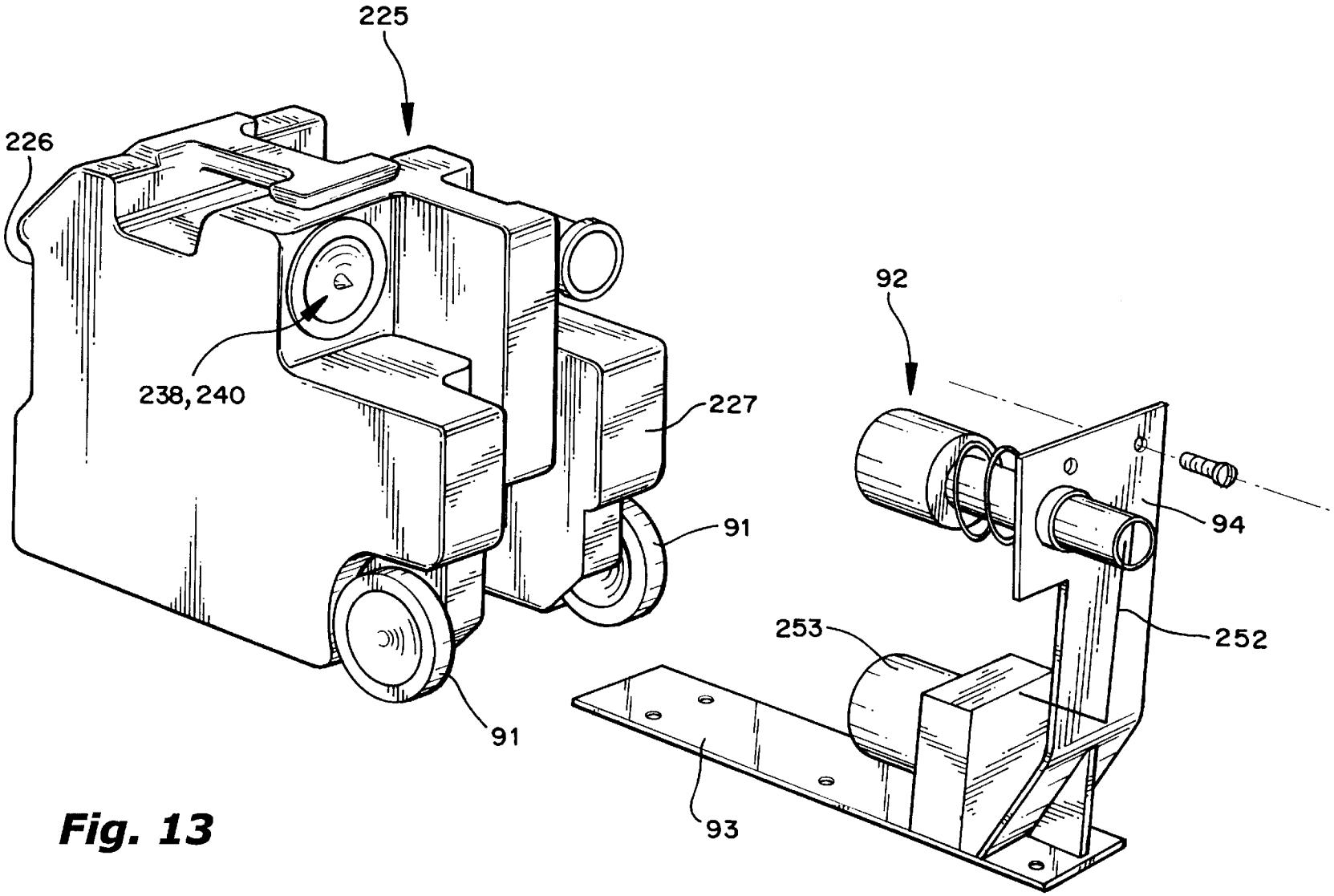
FIG. 13 is a rear perspective view of the tank of FIG. 12 with the vacuum pump and conduit components attached thereto shown disconnected so that the tank can be readily moved to a location for pumpout.

Another embodiment according to the invention is shown schematically in FIGS. 12 and 13. In this embodiment components comparable to those in the other embodiments are shown by the two digit reference numeral only preceded by the numeral "2".

FIG. 12 shows the all uninreinforced plastic combined vacuum and holding tank 225 according to the invention connected to a toilet 210 by conduit 211. In this embodiment the tank 225 is shown with a handle 90 pivotally connected to a front portion thereof, and with rolling facilitating elements 91 connected to the opposite end of the tank 225 from the handle 90. The handle may pivot into a position where it is out of the way or may be moved to the position illustrated in FIG. 12 and pulled up upon to lift the front end 226 off a support surface in the boat or recreational vehicle, so that the rolling elements 91 support the tank 225 to allow ready movement thereof. The rolling facilitating elements 91 may be conventional wheels, casters, rollers, or the like.

In this embodiment a combined inlet for sewage and outlet to the vacuum pump is provided as indicated generally at 238, 240. That is, the inlet 238 and the second outlet 240 have a common opening in this embodiment. A substantially fluid (and vacuum) tight, substantially no drip connection—shown generally by reference numeral 92—is provided to quickly connect and disconnect the tank 225 from the conduit 211, and from a conduit 252 (see FIG. 13) connecting the quick connect/disconnect 92 to the vacuum pump 253.

The vacuum pump 253 is preferably mounted on a bottom plate 93, while the coupling 92 is mounted on a substantially vertical plate 94, which plates 93, 94 are connected together. Any suitable mechanism may be utilized to hold the plate 94 and/or the plate 93 to the tank 225 when the tank 225 is functioning as a sewage holding and vacuum reservoir tank. The coupling 92, inlet 238, 240, etc. are not part of this invention, but are shown in co-pending application Ser. No. 08/838,238 filed Apr. 17, 1997 (atty. dkt. 19-132).

FIG. 13 shows the tank 225 disconnected from the vacuum pump 253 and the quick connect coupling 92 (which is connected to the conduit 211) for easy movement out of the boat or recreational vehicle to a pumpout station. The tank 225 can be replaced once emptied, or replaced with another tank of comparable construction. Of course the tank 225—as in the other embodiments—preferably has no continuous flat surface that is greater than about eighty square inches.

When used for recreational vehicles or caravans, the tank according to the invention may have a different configuration and size than as described above, but preferably is generally parallelepiped and has a contoured, convoluted, discontinuous (e.g. interrupted by grooves, channels, and other discontinuities) exterior surface with no continuous flat area greater than about 80 square inches, and is either rotational molded or injection molded of all (substantially unreinforced) plastic.

While the invention has been herein shown and described in an eminently suitable embodiment, it will be understood that many modifications and additions can be made thereto. For example equipment for injecting deodorizing chemicals into the tank 25 (either automatically or manually) may be provided, as well as various filters, stabilizing mounting structures, or the like. Therefore it is intended that the invention be given the broadest interpretation of the appended claims so as to encompass all equivalent structures.

What is claimed is:

1. A combined vacuum and holding tank assembly comprising:

a substantially hollow all plastic, with substantially no elongated fibers incorporated into the plastic, tank having first and second ends, first and second generally planar sides, first and second outlets, an inlet, an upper surface, and a bottom, said tank having a contoured, convoluted, discontinuous surface so that the tank has no continuous flat surface area of more than 80 square inches;

a vacuum pump mounted exteriorly of said tank;

a gas inlet tube disposed within said tank and connected to said second outlet; and a connection between said vacuum pump and said second outlet exterior of said tank.

2. An assembly as recited in claim 1 wherein said tank convoluted, discontinuous surface is formed by grooves or channels, which provide structural reinforcement, and is non-cylindrical.

3. An assembly as recited in claim 1 further comprising a conduit connected to said first outlet, for discharging sewage from said tank.

4. An assembly as recited in claim 1 further comprising at least one pump mounting surface of said tank, said vacuum pump mounted thereon.

5. An assembly as recited in claim 1 wherein said tank has an interior volume of between about 45–65 liters, and maintains a vacuum that is a maximum of about 26 cm of mercury.

6. An assembly as recited in claim 1 wherein said tank comprises injection molded plastic.

7. An assembly as recited in claim 4 wherein said at least one pump-mounting surface comprises a top surface and includes a second pump-mounting top surface; and further comprising a sewage discharge pump mounted on said second pump-mounting top surface and connected to said first outlet.

8. An assembly as recited in claim 4 wherein said second outlet and said inlet have a common opening.

9. An assembly as recited in claim 1 wherein said gas inlet tube has a top open end adjacent said tank upper surface.

10. An assembly as recited in claim 1 further comprising: a vacuum switch mounted to said tank for sensing the level of vacuum in said gas volume, and for starting operation of said vacuum pump if the level of vacuum in said gas volume is lower than a predetermined amount.

11. An assembly as recited in claim 1 further comprising a vacuum relief valve mounted to said tank.

12. An assembly as recited in claim 1 wherein said first and second outlets are on opposite sides of a vertical plane substantially bisecting said tank and intersecting said first and second ends thereof, and face in opposite directions.

13. An assembly as recited in claim 1 wherein said bottom is formed with a slope toward a sump, and integral plastic legs support said tank on a horizontal surface so that said sump is the lowest part of said tank.

14. An assembly as recited in claim 1 further comprising a downwardly extending sewage transporting tube disposed within said tank connected to said first outlet; and wherein said downwardly extending tube comprises a dip tube having an end termination cut at an angle, defining a generally oval shaped opening disposed adjacent a sump.

15. An assembly as recited in claim 1 wherein said discontinuous, convoluted surface comprises discontinuities besides grooves and channels, and wherein said tank is generally parallelepiped in configuration.

16. A human waste handling assembly mounted in a boat, plane, train or recreational vehicle having an exterior partition, and comprising:

at least one toilet having a waste discharge therefrom;

a substantially hollow all plastic, with substantially no elongated fibers incorporated into the plastic, tank having first and second ends, first and second sides, first and second outlets, an inlet, an upper surface, and a bottom, said tank having a contoured, convoluted, discontinuous surface so that the tank has no continuous flat surface area of more than 80 square inches;

a conduit connecting said tank inlet to said toilet waste discharge;

a vacuum pump connected to said second outlet;

a gas handling conduit from said vacuum pump including an end termination penetrating the boat, plane, train or recreational vehicle exterior partition; and a sewage handling conduit operatively connected to said first outlet and having an end termination penetrating said partition.

17. An assembly as recited in claim 16 wherein said tank convoluted, discontinuous surface is formed by grooves or channels, which provides structural reinforcement, and wherein said tank is generally parallelepiped in configuration.

18. An assembly as recited in claim 16 wherein said tank has a handle and rolling facilitating elements.

19. An assembly as recited in claim 16 wherein said tank maintains a vacuum level that is a maximum of about 26 cm of mercury, and has an interior volume of about 45–65 liters.

20. An assembly as recited in claim 16 wherein said tank is non-cylindrical, and further comprising: a vacuum switch mounted to said tank for sensing the level of vacuum in said gas volume, and for starting operation of said vacuum pump if the level of vacuum in said gas volume is lower than a predetermined amount; and a vacuum relief valve mounted to said tank.

* * * * *